United States Patent [19]

Lawson, Jr. et al.

[11] 3,972,176

[45] Aug. 3, 1976

[54] METHOD OF TREATING SYNTHETIC YARNS

[75] Inventors: John C. Lawson, Jr., Washington; Chester A. Williams, Lake Waccamaw, both of N.C.

[73] Assignee: National Spinning Company, Inc., New York, N.Y.

[22] Filed: Oct. 3, 1974

[21] Appl. No.: 511,937

Related U.S. Application Data

[63] Continuation of Ser. No. 359,124, May 10, 1973, abandoned.

[52] U.S. Cl. ..... 57/157 TS; 28/21; 57/157 R

[51] Int. Cl.[2] ..... D02J 1/12

[58] Field of Search..... 57/157 R, 157 TS, 157 MS, 57/156, 34 HS, 34 R; 68/5 D; 28/21

[56] References Cited

UNITED STATES PATENTS

| | | | |
|---|---|---|---|
| 2,722,729 | 11/1955 | Wilhelm | 28/21 |
| 2,723,440 | 11/1955 | Corbiere et al. | 28/21 |
| 3,025,661 | 3/1962 | Stub, Jr. et al. | 57/157 TS |
| 3,683,650 | 8/1972 | Hirschburger | 68/5 D |
| 3,774,384 | 11/1973 | Richter | 57/157 TS X |

*Primary Examiner*—Richard C. Queisser
*Assistant Examiner*—Charles Gorenstein
*Attorney, Agent, or Firm*—Cushman, Darby & Cushman

[57] ABSTRACT

A novel and improved carpet yarn for cut-pile carpets is produced by twisting a strand of yarn having pre-existing latent filament crimp characteristics to a predetermined twist level in a given direction and then plying it with a similar strand or strands having the same amount of twist inserted therein in the same direction. The yarns are plied together, receiving a ply twist essentially equal in amount to the twist in the single strands, but in the opposite direction. The plied yarn is then wound on a rotating mandrel which is also adapted to advance the yarn along the length of the mandrel and through a treatment zone wherein predetermined conditions of heat and moisture are applied to fully develop the latent crimp characteristics of the yarn filaments. The plied yarn is then removed from the opposite end of the mandrel under a minimum tension which is maintained only long enough to remove the yarn from the mandrel and which is immediately relieved by depositing the yarn under no tension in a suitable container for further treatment. The yarn is deposited in such containers in a substantially uniform low density mass wherein linear segments of the yarn are arranged in an irregular short-term configuration which is obtained by rotating the containers while placing the yarn along the radii thereof in a recirpocating fashion. The container of yarn is then positioned in a second treatment zone wherein the yarn is subjected to more severe conditions of heat and moisture adequate to permanently set in the yarn the previously manifested filament crimp characteristics, the yarn twist and ply twist, and the irregular short-term configuration of the plied yarn.

10 Claims, 3 Drawing Figures

METHOD OF TREATING SYNTHETIC YARNS

This is a continuation, of application Ser. No. 359,124 filed May 10, 1973, now abandoned.

BACKGROUND OF THE INVENTION

1. Field of the Invention

This invention relates to methods and apparatus for the production of novel and improved carpet yarns, and more particularly, to the production of heavy denier continuous filament yarns for cut-pile carpets, although the processes herein described may also have application to the production of yarns for other purposes, such as spun yarns for handknitting.

2. Prior Art

The process described herein has been found to have especially significant application in the field of yarns which are produced from synthetic filament yarns which have been "pre-bulked" by the producer thereof in connection with the yarn spinning and manufacturing processes. Such yarns, produced and sold, for example, by the E. I. DuPont de Nemours Company, are known in the trade as "BCF" yarns, meaning "bulked continuous filament" yarns. These are yarns which have been endowed with certain properties by the yarn producers in the manufacturing processes, by heretofore unspecified means, which result in such filament yarns possessing certain latent tendencies to subsequently crimp or deform under the application of certain conditions of heat and moisture.

It has been found, however, that BCF yarns should not be initially subjected to temperature conditions that are overly severe, so that these yarns, which also have thermoplastic properties, do not become "set" prior to or concurrently with the onset of the manifestation or development of the theretofore latent properties in the yarn. Moreover, it is known that the application of linear tensions, such as are common in the continuous processing of yarns, during the period of the supposed development of manifest crimp will significantly retard or even suppress entirely the development of the full crimp properties possessed by the BCF yarns.

It has also been found that the crimp characteristics of BCF yarns, once developed and made manifest, are extremely fragile and can still be distorted, damaged, or even destroyed altogether by the subsequent handling processes which are commonly employed in the textile trade. For purposes of an illustrative example, a synthetic or thermoplastic yarn which is texturized in the currently widely employed false-twist process is continuously subjected to linear tensions on the order of at least 0.06 grams/denier, and the yarn, after receiving its manifest crimp by removal of twist, is usually subjected to tensions of about 0.4 grams/denier or higher without, however, materially adversely affecting the final texture or crimp in the finished yarn. Such tensions, applied to BCF yarns, upon the manifestation of their crimp characteristics, simply straighten and permanently remove the crimped deformations, thereby rendering the yarn substantially untexturized, and in any event, entirely unsuitable for the desired end uses.

Heretofore, all of the known processes for producing commercially suitable yarns for BCF yarns have been limited by the factors mentioned above, to the step-by-step formation, handling and multiple treatment of discrete hanks or skeins of the yarn. These known processes, and the resulting yarn products, are subject to a plurality of inherent defects, deficiencies and inefficiencies. Among these are the following: (a) loss of significant latent crimp properties, which are never developed and made manifest in the yarn; (b) removal and eventual loss of manifested crimp by the required subsequent handling processes; (c) nonuniform development of manifest crimp; (d) non-uniformity of dye-uptake, resulting in "streakiness" in the finished product; and (e) excessive costs due to the number of handling operations and treatments that must be applied to obtain yarns of minimum suitability for the desired end use.

Accordingly, it is an object of the present invention to provide a method for processing BCF yarns so as to initially develop and render manifest, and to a significantly greater extent than previously possible, substantially all of the latent properties induced therein by the yarn producer; for further processing the yarns, without substantially degrading or damaging the latent properties which have been rendered manifest; and for permanently fixing or setting the thus manifest properties so as to produce yarns useful for carpets and the like which retain their full, uniform, bulk and crimp throughout subsequent finishing and manufacturing operations and display significantly improved and durable bulk and "cover" while in service.

It is a further object of the invention to provide a method for bulking and setting BCF yarns in a continuous process which substantially reduces the number of lengthy and expensive operations required by previously-known processes.

It is a further object to provide carpet yarns for cut-pile carpets and the like which display substantially increased bulk and cover, as compared with like yarns of the same weight which are produced by prior art methods.

It is a further object of the present invention to provide carpet yarns for cut-pile carpets and the like which display unique aesthetic qualities and improved covering properties, as compared to like yarns produced by previously-known methods, by reason of an irregular linear formation permanently set in the yarns.

It is a still further object to provide means and apparatus for efficiently and economically carrying out the methods herein disclosed, and achieving these and other objects of the present invention.

SUMMARY OF THE INVENTION

The above objects are achieved by providing a process wherein a yarn having pre-existing latent crimp characteristics is first slightly twisted with a low number of turns per inch in one direction and then plied with a similar strand or strands of yarn having a twist in the same direction, the strands being given a ply twist approximately the same number of turns per inch as were inserted into each individual strand, but in the opposite direction. These plied strands are then wound on a rotating mandrel adapted to spirally convey said yarn along the longitudinal length of the mandrel. As the yarn is carried along the mandrel, it is continuously advanced through a first treatment zone wherein it is subjected to predetermined conditions of temperature and moisture that develop the latent crimp characteristics of the yarn and render them manifest, but without setting the yarn. As the yarn advances through the treatment zone the rotating of the mandrel, in conjunction with the longitudinal movement of the yarn along the mandrel, results in each yarn segment being subjected to at least the same minimum conditions of temperature and moisture. The yarn is then continuously removed from the opposite end of the mandrel utilizing a minimum amount of tension to remove the yarn, which tension is immediately relieved thereafter as the plied yarn is then drawn through a set of feed rolls, and is subsequently deposited under no appreciable tension in treatment container. The yarn is deposited in a manner that provides a substantially uniform un-compacted mass of yarn within the container. Once the container is substantially filled, it is removed and positioned in a second treatment zone wherein more severe conditions of humidity and temperature are applied which are adequate to permanently set the manifest crimp characteristics in the yarn. The yarn is then removed from the second treatment zone and can be subsequently fabricated into carpet pile, or as otherwise desired. Carpets from yarns so produced have been found to have substantially greater cover and bulk than like yarns processed according to previously known methods, for the same weight of yarn.

It has also been found that when the filling of the container is accomplished by rotating the cylindrical container as the yarn is being deposited by a reciprocating member which carries the yarn back and forth along the radius of the axis of rotation of the container, significantly different and desirable characteristics are imparted to the finished yarn, which further improve the cover of the yarn after fabrication into carpet.

DETAILED DESCRIPTION OF THE PREFERRED EMBODIMENT

Our preferred procedures may conveniently be described in connection with, and by reference to, the particular apparatus disclosed in the above-identified drawings. However, it should be understood that the diagrammatical representation of apparatus pictured therein is merely for the purpose of illustration and is not intended as a limitation in respect to the type or form of apparatus that may be employed.

Figure 1:
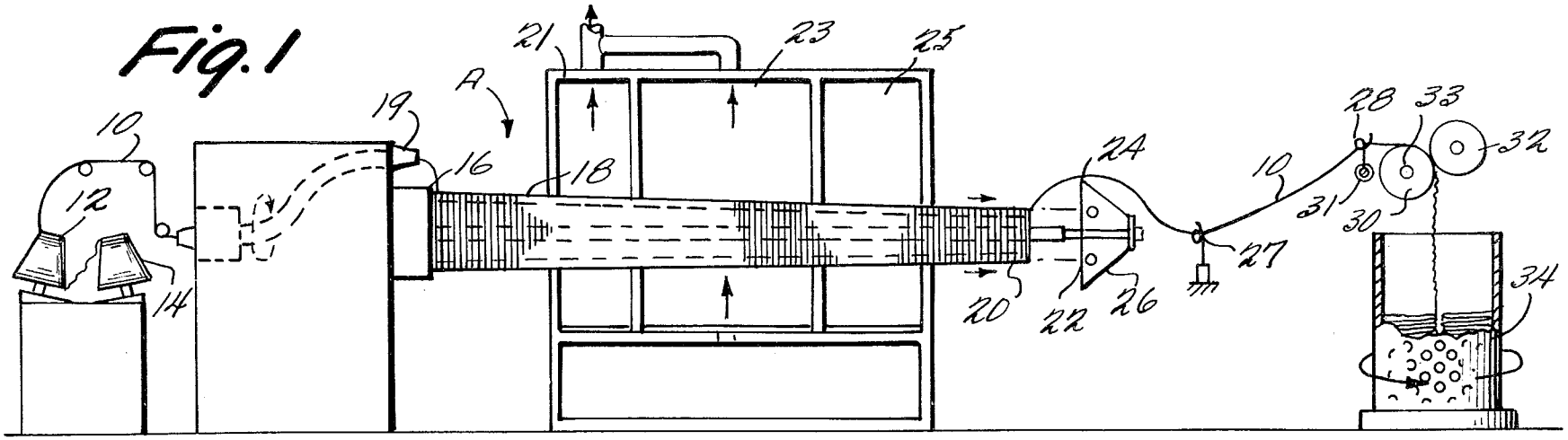
FIG. 1 is a diagrammatic view illustrating the sequence of yarn treatment and relative position of the components of the apparatus useful in the practice of the present invention.

Referring generally to FIG. 1, the specially prepared yarn, described in greater detail below, is processed through a yarn winding apparatus A wherein a plied yarn 10, unwound from a package 12, is supplied to one end 16 of a rotating mandrel 18 by means of a rotating flyer 19. Rotating mandrel 19 consists of a series of suitably supported conveyor belts 20, four or six for example, which are spaced around the axis of rotation of mandrel 18, and converge toward that axis as the distance from the flyer 19 increases. The outer surfaces of conveyor belts 20 are adapted to travel away from the flyer, toward the opposite end 22 of mandrel 18. This movement, in conjunction with the mandrel rotation, causes yarn 10 to spirally advance along mandrel 18 as the yarn is continuously laid thereon by the flyer.

The plied yarn 10 may be prepared by first lightly twisting a suitable BCF yarn, for example, a 1200 denier nylon yarn containing 68 filaments. The twist given this yarn may be on the order of 2.5 to 4.5 turns per inch, in the z direction. This twisting may be accomplished by any known means, such as the well known "up-twister" apparatus, but special care should be taken to ensure the uniformity of twist in the yarn. After twisting, two or more similar strands, each of which have been twisted to substantially the same level and in the same direction (Z or S), are plied together, receiving in the process a ply twist in the opposite direction from that of the "singles" yarn, and to substantially the same level of twist. Thus, if each of the singles yarns were given a twist of three turns per inch in the Z direction, then the ply twist should then preferably be three turns per inch in the S direction. Again, the plying may be carried out by any of the well known means available to the textile trade and, for that reason, a more detailed description of the apparatus and of the precise methods of obtaining the plied yarn 10 should not be required by those of skill in the art.

When the plied yarn 10 is laid upon the mandrel end 16, the movement of the belts 20 will ordinarily ensure that the subsequent winding of yarn will not be superimposed upon prior windings, but will contact the tape along a path longitudinally spaced from the path of the previous winding. It will be recognized from the preceding descriptions that the spacing between adjacent coils of yarn on the mandrel 18 can thus be varied, depending upon the chosen speed of rotation of the flyer 19 and the chosen linear speed of the belts 20. We have found that the precise spacing between adjacent coils of yarn 10 is not critical, but it is important, however, that a plurality of coils of the yarn not be permitted to bunch together or become superimposed upon one another, as those conditions may adversely affect or defeat the results otherwise achieved by the use of our invention. Preferably, some spacing, however slight, should be maintained between adjacent coils so as to permit passage of air currents through the windings to thus ensure thorough heat and moisture penetration of the yarn, as hereinafter more fully described.

As yarn 10 advances along mandrel 18, it passes into and through a treatment zone which may conveniently comprise compartments 21, 23 and 25. Heated and moisturized air enters the treatment zone in compartment 23 so as to maintain that compartment under temperature and humidity conditions on the order of 180° – 190° F dry bulb and 170° F wet bulb. Exhaust ducts in compartment 23, either alone or in combination with ducts in compartment 21, draw off air thereby creating circulation of the heated and moisturized air and promoting uniform distribution of heat and humidity throughout compartment 23. Due to the rotation of converging mandrel 18, each linear segment of yarn 10 passing therethrough is thus subjected to essentially the same conditions existing in the treatment zone, which permits uniform treatment of the yarn should there be any variation in the processing conditions from one portion of the zone to another.

It is important to note that the treatment zone is disposed along the longitudinal axis of the mandrel 18 a sufficient distance from end 16 so that, due to the decreasing circumference to the mandrel, the coils of yarn lay very slack and loose about the belts 20, and without tension other than that caused by the weight of the yarn in each coil, when first subjected to the heat and moisture conditions mentioned above. We have found that the yarn thus arranged on the mandrel is uniquely capable of developing its latent crimp properties to a greater extent than that previously obtainable under known conditions of heat and moisture.

As the plied yarn 10 passes into and through compartment 23, the latent properties of the yarn are thus developed by the passage of the heat and moisturized air in intimate contact with the yarn and each linear segment of the yarn is also subjected to essentially the same conditions of heat and moisture in a tension-free state. We have found also that the uniformity of dye uptake of the finished yarn is considerably improved, thus eliminating streakiness in the fabricated carpet, when, according to the procedures described herein, each segment of the yarn is subjected uniformly to the minimum heat and moisture conditions which are required to develop the latent properties of the yarn. Surprisingly, however, we have also found that, once this development has taken place, further dwell time of the yarn in the treatment zone has no apparent deleterious effects, either with respect to crimp, tenacity or dyeability, in the finished yarn.

As the yarn 10, having received full development and manifestation of its latent properties, proceeds through compartment 25 on the mandrel, it is dried somewhat by a counter-current of air adjacent to the mandrel, which is drawn from outside the zone. Upon reaching the small end 22 of the mandrel, the yarn 10 still remains somewhat damp, however, and is still supported very loosely by the belts 20 so as not to damage or remove the very fragile crimp formations which have been developed in the treatment zone.

The yarn 10 must thus be removed from the mandrel with extreme care and under the minimum tensions obtainable. We have found that the normal winding operations employed in the textile industry apply much greater tensions than the manifest crimp formations can withstand, and we, therefore, deem the following steps of removing the yarn from the mandrel to be of particular importance. The yarn 10 is drawn over-end from the mandrel by the action of driven rollers 30 and 32. The yarn is then led to the rollers 30, 32 through a centering guide 27 which is in generally axial alignment with the mandrel, and then through a guide 28 which is mounted on a reciprocating shaft 31 so as to longitudinally traverse the feed rolls 32 and 30. Upon passing through the rolls 32, 30 all measurable tension on the yarn is relieved, and the yarn is deposited in the cylindrical treatment container 34.

By adjusting the linear speed of the feed roll surfaces to the speed of rotation of the flyer, we can remove the yarn at speeds of 800 yarns per minute without inducing tensions in the yarn greater than about 0.015 grams per denier. Tensions of at least 0.01 grams per denier are difficult to avoid, simply due to the weight of the ballooning yarn as it is removed from the mandrel. However, despite the fragile nature of the crimp in the yarn, we have found that when the rolls 32, 30 are placed within a distance of about 10 feet from the end of the mandrel, the yarn is subjected to the aforementioned tensions for a period of less than about three-tenths of a second at the speeds indicated, and that the minimum tensions mentioned above can be sustained by the yarn for at least that momentary period of time without appreciable degradation of manifest crimp.

Figure 2:
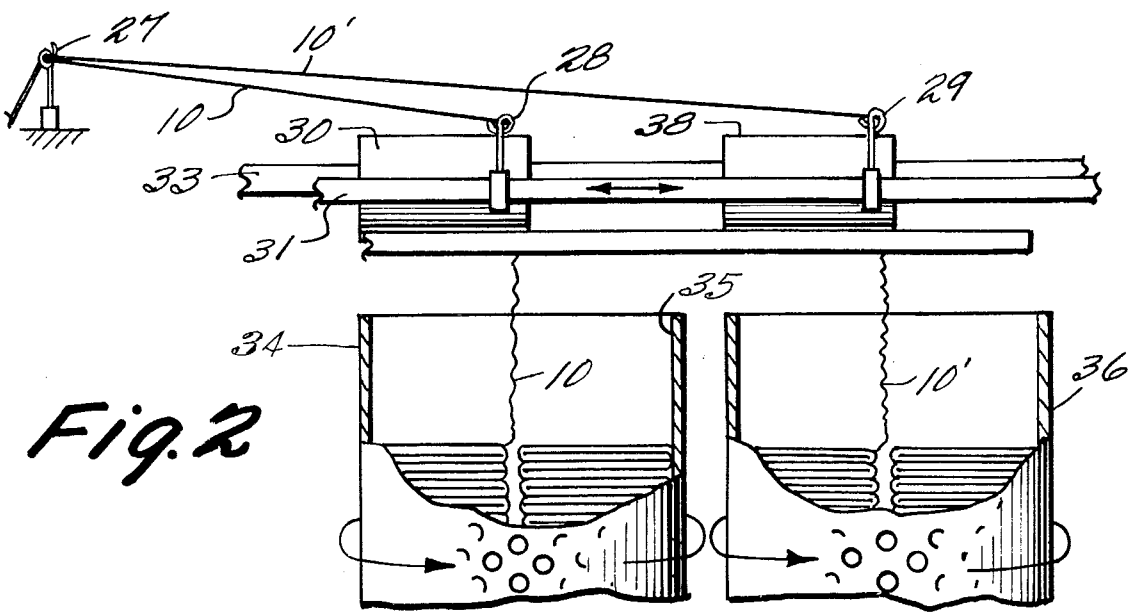
FIG. 2 is a diagrammatic view further illustrating the depositing of the treatment container, and also illustrating an arrangement wherein a plurality of containers which may be simultaneously filled according to the practice of the invention.

In order to more clearly understand the manner in which the yarn is deposited in container 34, reference may also be made to FIG. 2 of the drawings. Cylindrical container 34 is rotated about its vertical axis and guide 28 is reciprocated by shaft 31 between a position substantially adjacent the axis of rotation of container 34 radially outward therefrom to a position substantially adjacent the internal perimeter 35 of container 34. This movement of guide 28 causes the plied yarn 10 to laterally traverse the feed rolls 30 and 32 without losing contact with the peripheral roll surfaces, thus causing the yarn 10 to be deposited in evenly distributed folds throughout the container, and uncompressed except for the weight of the yarn deposited above.

As the yarn 10 is thus laid into the container 34 an extremely uncompacted, low-density mass of yarn is formed. Further, due to the manifest crimp formations in the yarn and the bends and turns which are induced in the yarn by the interaction of the motions described in the preceding paragraph, the yarn in the container assumes a highly irregular short-term configuration. That is, in addition to the crimp and deformations made manifest in the yarn by the heat and moisture treatment previously described, additional deformations are created in the yarn as it is deposited by the rolls into the rotating container 34.

When the container, which may be on the order of 16 inches in diameter is filled, all operations, including the rotation of the flyer 19 and mandrel 18, can be stopped by an operator who then severs the yarn 10 immediately above container 34 and replaces the filled container 34 with an empty container of like construction. The operator, in accordance with well-known textile practices, can provide "transfer tails" at each end of the length of yarn in a given container, for convenience of subsequent handling.

A filled container 34, either separately or with such other filled containers, is then autoclaved under conditions of approximately 240°–270°F in saturated steam for a period which may vary depending upon the exact temperature employed, preferably about 30 minutes. It should be noted that although BCF yarns have been autoclaved at similar temperatures in previously known processes, such processes usually include additional steaming steps at somewhat lower temperatures than those mentioned above. Those additional steps, we surmise, are primarily for the purpose of attempting to redevelop manifest crimp and bulk removed from the yarn in the handling processes preceding autoclaving. When the same BCF yarns are processed according to the procedures outlined herein, however, such additional steaming steps are rendered unnecessary, and the resulting products are still superior in crimp and bulk to the yarns produced by such prior processes.

After the autoclave treatment, the plied yarn 10 may be removed from the container 34 by any suitable procedure and used accordingly. When fabricated into carpets, the resulting yarn has been found to have superior bulk, due to a greater degree of crimp and twist which had been permanently set into the yarn in the autoclave. In addition, such yarns differ from previous BCF carpet yarns in that they display, in the final cut-pile carpet, an aesthetically pleasing irregular linear configuration which has also been set into the yarn by the autoclave processing. This irregular configuration, in addition to its aesthetic qualities, further adds to the bulk and "covering power" of the yarn to the extent that yarns produced according to our invention apparently possess approximately 15% more covering power than like yarns of like denier produced according to prior methods. Stated another way, in a cut-pile shag carpet produced from our yarn, for example a typical section containing 12 oz. of yarn per square unit will provide as much covering power as 14 oz. or more of the same denier yarn which was processed according to prior methods.

Referring further to FIG. 2, we have found that more than one end of plied yarn 10 may be processed at a given time according to the steps prescribed above, and that both ends may be removed simultaneously from the mandrel 18, also as described above, and deposited in separate containers 34 and 36 by the use of additional guide 29 and feed rolls 38 and another not shown. According to this modification, an additional end of yarn is simply fed from the creel into the flyer 19 and both ends of plied yarn 10 are laid simultaneously upon the mandrel as described previously. Both ends of yarn 10 may also be removed from the mandrel 18 at end 22 and passed through the same guide 27. From that point, as illustrated in FIG. 2, they are separated, each yarn passing to its separate guide, 28 or 29, traversing separate sets of identical feed rolls. When so processing separate ends, care must be maintained to ensure that each end is removed from the mandrel 18 at the same linear speed and is deposited by the feed rolls at the same linear speed. Accordingly, it is most convenient to place the guides 28 and 29 on the same reciprocating shaft 31 and to have the drive rolls turned at the same speed by the same drive shaft 31.

Figure 3:
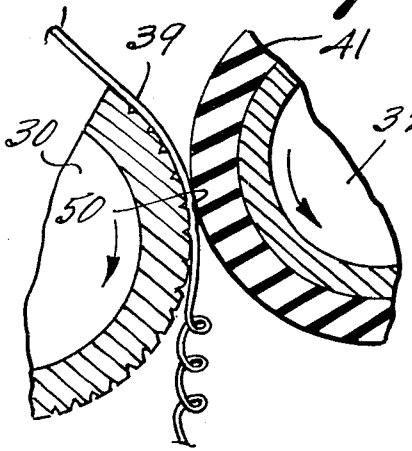
FIG. 3 is a partial diagrammatic view showing the construction of feed rolls which may be used to deposit the yarn in the containers.

As further illustrated in FIG. 3, the surfaces of both feed rolls may both be covered with a rubber or like synthetic material 41, or one roll 32 may be covered with rubber while the other roll has a serrated steel surface 39 for more positive gripping of the yarn 10.

Although there exist several types of commercially available apparatus which include rotating mandrels and can be used for the thermal treatment of textile fibers, the type presently preferred by us in the practice of our invention is that designated as the "HBS" machine, manufactured by Eugen Hirschburger, KG of Reutlingen, West Germany, which can be suitably modified and adapted to carry out the procedures specified herein.

To the extent not previously explained, the following example of the utilization of our invention should serve to instruct those skilled in the art of the general parameters of speeds, tension, temperatures and other processing conditions that may be employed. First, assuming the use of a 2400 denier BCF yarn, a twist of 2.5 turns per inch in the Z direction is inserted in each of two strands of yarn. The strands are then plied together, receiving a ply twist of 2.5 turns per inch in the S direction. The yarn is then inserted into the HBS machine so that the flyer 19 winds the plied yarn, containing a total of 4800 denier, about the mandrel at a linear rate in excess of 1000 yards per minute. The diameter of the larger end 16 of the mandrel is about 1 meter, the rotational speed of the mandrel is 20 R.P.M., and the speed of the belts 20 is adjusted to about 10 feet per minute to ensure that the yarn wound about the mandrel is evenly deposited, rather than bunched together or superimposed, as discussed previously, The treatment zone of the HBS machine is modified and adapted, also as discussed previously, to apply heat and moisture conditions to the slack and untensioned yarn so as to fully develop its latent crimp characteristics. Feed rolls 32, 30 are rotated at a speed adapted to continuously withdraw the yarn from mandrel 18 at a linear velocity of about 800 yards per minute and the tensions thus developed are immediately relieved as the yarn passes through the feed rolls 32, 30 and is deposited in container 34. The speed of rotation of the container may be on the order of 8 revolutions per minute and a traverse speed of guide 28 may be selected in conjunction with the linear speed of the yarn and the rate of container rotation to ensure even distribution of yarn within the container. Also, the relative speeds of the container rotation, feed roll rotation, and yarn guide traverse may be varied to control the degree of bends and turns in the yarn which contribute to the irregular formations mentioned previously. Autoclave pressure may be selected, of course, depending upon the desired temperatures. Pressures providing treatment temperatures of at least 240°F are preferred. When it is desired to exchange an empty container 34 for a filled container, the apparatus may be stopped for a brief duration without damaging or causing non-uniformity in the yarn 10 which remains in the treatment zone for a longer than usual period of time.

Although the foregoing descriptions and example illustrate a preferred embodiment of our invention, it will be apparent to those skilled in the art, that variations are both possible and permissible. Accordingly, such variations as would be obvious to those skilled in the art are intended to be included within the scope of the invention we now claim.

What is claimed is:

1. A method of treating a bulked continuous filament synthetic yarn comprising the steps of:

lightly twisting a synthetic textile yarn having preexisting latent crimp and shrinkage characteristics;

continuously passing said yarn under no appreciable tension through a first moist heat treatment zone so as to develop said latent crimp characteristics of said yarn and render them manifest, while avoiding permanently setting the manifest crimp in the yarn;

continuously removing said yarn from said first treatment zone under minimum tension;

immediately relieving said yarn of said minimum tension;

depositing said yarn in a treatment container under conditions whereby said yarn is disposed in a substantially tensionless state in a substantially uniform, uncompacted mass;

treating said yarn in said container while maintaining said yarn in said substantially tensionless state in a second treatment zone under moist temperature conditions adequate to permanently set said manifest crimp characteristics; and removing said yarn from said container.

2. A method as defined in claim 1, wherein said step of depositing said yarn in a treatment container comprises:

rotating said container about a vertical axis; and distributing said yarn under substantially zero tension along the radius of said rotating container in a reciprocating manner from a position substantially adjacent said vertical axis to a position substantially adjacent the internal perimeter of said container so as to deposit said yarn in a configuration having bends throughout the length of yarn within said container at intervals of less than the width of said container.

3. A method of treating a bulked continuous filament synthetic yarn comprising the steps of:

feeding a lightly twisted synthetic textile yarn having pre-existing latent crimp and shrinkage characteristics onto a support;

passing said yarn through a first moist heat treatment zone under no appreciable tension so as to develop substantially all of the latent crimp characteristics of said yarn and render them manifest, while avoiding permanently setting manifest crimp formations in the yarn;

withdrawing said yarn from said support under conditions of minimum tension;

immediately relieving said yarn of said minimum tension;

depositing said yarn in a treatment container so as to form within said container a low-density, substantially uniform uncompacted mass; and further treating said yarn within said container in a second treatment zone under moist temperature conditions that are higher than in said first zone so as to substantially permanently set said manifest crimp characteristics in said yarn.

4. A method as defined in claim 3, wherein said step of passing said yarn through a first moist heat treatment zone under no appreciable tension comprises:

continuously conveying said yarn on said support through said first treatment zone, and continuously maintaining said yarn under tension conditions sufficient to accomodate substantially all of the shrinkage characteristics of the yarn and thereby permit substantially all of the latent crimp to become manifest.

5. A method as defined in claim 4, wherein the step of conveying said yarn on said support comprises:

winding said yarn on a rotating mandrel having conveying means so as to advance said yarn spirally along said rotating mandrel through said first moist heat treatment zone at linear yarn speeds on the order of at least 800 yards per minute.

6. A method as defined in claim 3 wherein said step of depositing said yarn in a treatment container comprises:

rotating said container about a vertical axis; and distributing said yarn under substantially zero tension along the radius of said rotating container in a reciprocating manner from a position substantially adjacent said vertical axis to a position substantially adjacent the internal perimeter of said container so as to deposit said yarn in a configuration having deformations throughout the length of yarn within said container at intervals of less than the width of said container.

7. A method as defined in claim 3, which additionally comprises the steps of:

maintaining said first moist heat treatment zone under temperature conditions of about 170°–200°F in the presence of substantial moisture; and providing temperature conditions in said second treatment zone of about 240°–270°F in the presence of saturated steam.

8. A method of treating a bulked continuous filament synthetic yarn comprising the steps of:

lightly twisting a synthetic textile yarn having pre-existing latent crimp and shrinkage characteristics;

feeding said yarn onto a rotating support;

passing said yarn on said support through a first moist heat treatment zone;

maintaining said yarn under tension conditions within said treatment zone sufficient to accomodate substantially all of said shrinkage charcteristics and thereby permit substantially all of the latent crimp characteristics of the yarn to become manifest, but without permanently setting manifest crimp characteristics in the yarn by said treatment;

withdrawing said yarn from said rotating support under conditions of minimum tension;

depositing said yarn in a treatment container so as to form within said container a low-density, uncompacted mass of yarn in a configuration having deformations throughout the length of the yarn within said container at intervals of less than the width of said container; and further treating yarn in said treatment container under moist temperature conditions that are higher than in said first zone so as to substantially permanently set said manifest crimp characteristics in said yarn and to substantially permanently set said twist in said yarn.

9. A method as defined in claim 8, wherein said step of lightly twisting a synthetic textile yarn comprises:

twisting a single strand of said yarn in one direction so as to insert at least two turns per inch actual twist in said yarn;

plying said single strand with at least one other single strand similarly twisted;

ply twisting said strands in the opposite direction to that of the twist in the single strands to approximately the same number of turns as previously inserted in said single strands.

10. A method of treating continuous filament synthetic yarn having latent crimp characteristics so as to substantially fully develop its crimp characteristics and to subsequently set the yarn while avoiding intervening deterioration of manifest crimp in order to obtain a bulked set yarn having improved covering power, comprising the steps of:

placing a lightly twisted synthetic textile yarn having pre-existing latent crimp and shrinkage characteristics on a rotating support in closely spaced, substantially uncompacted coils;

passing said twisted yarn on said support through a first moist heat treatment zone under conditions of temperature and moisture sufficient to render manifest the said latent crimp characteristics, but without permanently setting manifest characteristics in the yarn;

continuously maintaining said yarn under substantially tensionless conditions within said treatment zone so as to permit substantially all of the latent crimp characteristics of the yarn to become manifest;

withdrawing said yarn from said rotating support under correlated conditions of yarn travel so as to apply only minimum tension to the yarn for a duration of a fraction of one second;

relieving all tension on said yarn and depositing said yarn in successive treatment containers so as to form within each of said containers a low-density, uncompacted mass of yarn in a configuration having bends throughout the length of the yarn within said container at intervals of less than the width of said container; and further treating said yarn in said treatment containers under moist temperature conditions higher than the said first zone so as to substantially permanently set said manifest crimp characteristics in said yarn, to substantially permanently set said twist in said yarn, and to substantially permanently set said bends in said yarn.

* * * * *